US008523654B2

(12) United States Patent
Nguyen

(10) Patent No.: US 8,523,654 B2
(45) Date of Patent: Sep. 3, 2013

(54) METHOD OF GAMING, A GAME CONTROLLER AND A GAMING SYSTEM

(75) Inventor: Hung Ngoc Nguyen, Sefton (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 709 days.

(21) Appl. No.: 12/351,512

(22) Filed: Jan. 9, 2009

(65) Prior Publication Data

US 2010/0178974 A1 Jul. 15, 2010

(30) Foreign Application Priority Data

Jan. 9, 2008 (AU) ..... 2008900104

(51) Int. Cl.
*A63F 13/10* (2006.01)

(52) U.S. Cl.
USPC ..... 463/20

(58) Field of Classification Search
USPC ..... 463/16–21
See application file for complete search history.

(56) References Cited

U.S. PATENT DOCUMENTS

| | | | | |
|---|---|---|---|---|
| 5,395,111 | A * | 3/1995 | Inoue | 273/143 R |
| 5,833,537 | A * | 11/1998 | Barrie | 463/21 |
| 6,190,254 | B1 | 2/2001 | Bennett | |
| 6,439,993 | B1 | 8/2002 | O'Halloran | |
| 6,579,178 | B1 | 6/2003 | Walker et al. | |
| 7,371,171 | B1 * | 5/2008 | Englman et al. | 463/20 |
| 7,591,724 | B2 * | 9/2009 | Baerlocher | 463/20 |
| 7,704,141 | B1 * | 4/2010 | Marks et al. | 463/20 |
| 2003/0134671 | A1 | 7/2003 | Meyer | |
| 2003/0211882 | A1 | 11/2003 | Smith et al. | |
| 2004/0097280 | A1 | 5/2004 | Gauselmann | |
| 2004/0266517 | A1 | 12/2004 | Bleich et al. | |
| 2005/0017449 | A1 | 1/2005 | Belcher et al. | |
| 2005/0064924 | A1 | 3/2005 | Glavich et al. | |
| 2005/0101369 | A1 | 5/2005 | Meyer | |
| 2005/0101380 | A1 | 5/2005 | Glavich et al. | |
| 2005/0164775 | A1 | 7/2005 | Rodgers et al. | |
| 2005/0288087 | A1 | 12/2005 | Meyer | |
| 2006/0058097 | A1 | 3/2006 | Berman et al. | |
| 2006/0068893 | A1 | 3/2006 | Jaffe et al. | |
| 2006/0068900 | A1 | 3/2006 | Englman | |
| 2006/0163806 | A1 | 7/2006 | Toyoda | |
| 2006/0252488 | A1 | 11/2006 | Lalonde et al. | |
| 2006/0264254 | A1 | 11/2006 | Aoki | |
| 2006/0273519 | A1 | 12/2006 | Aida | |
| 2007/0167223 | A1 | 7/2007 | Bleich et al. | |
| 2009/0239631 | A1 * | 9/2009 | Aoki et al. | 463/20 |

FOREIGN PATENT DOCUMENTS

| | | |
|---|---|---|
| CA | 2506141 | 11/2006 |
| CA | 2508080 | 12/2006 |
| GB | 1340030 | 12/1973 |

(Continued)

*Primary Examiner* — Julio J Maldonado
*Assistant Examiner* — Daniel Shook
(74) *Attorney, Agent, or Firm* — Hanley, Flight and Zimmerman, LLC.

(57) ABSTRACT

A method of gaming comprising: selecting a plurality of symbols for display at a plurality of display positions, the selecting being performed by selecting from a set of symbols including one or more modifiable symbols, each modifiable symbol adapted to receive a modifier; determining whether a corresponding modifier is a available for each selected modifiable symbol; modifying each selected modifiable symbol in respect of which a positive determination is made by adding the modifier to the modifiable symbol; and determining whether to make an award based on the plurality of symbols as modified.

77 Claims, 8 Drawing Sheets

(56) References Cited

FOREIGN PATENT DOCUMENTS

| | | |
|---|---|---|
| GB | 2437388 | 10/2007 |
| JP | 2006158776 | 6/2006 |
| JP | 2006289122 | 10/2006 |
| JP | 2006290450 | 10/2006 |
| MX | PA03010155 | 3/2004 |
| WO | WO2004076014 | 9/2004 |
| WO | WO2006118005 | 11/2006 |
| WO | WO2007100945 | 9/2007 |

* cited by examiner

METHOD OF GAMING, A GAME CONTROLLER AND A GAMING SYSTEM

CROSS-REFERENCE TO RELATED APPLICATIONS

The present application claims the benefit of priority to Australian Provisional Patent Application No. 2008900104, filed on Jan. 9, 2008, entitled "A METHOD OF GAMING, A GAME CONTROLLER AND A GAMING SYSTEM", which is herein incorporated by reference in its entirety.

FIELD

The invention relates to a method of gaming, a game controller and a gaming system.

BACKGROUND

Many gaming machines provide spinning reel or "slot" games where a plurality of reels are spun to stop positions and prizes are evaluated based on the symbols displayed when the symbols are stopped.

While such gaming systems provide users with enjoyment, a need exists for alternative gaming systems in order to maintain or increase player enjoyment.

SUMMARY OF THE INVENTION

In a first aspect, the invention provides a method of gaming including:

selecting a plurality of symbols for display at a plurality of display positions, the selecting being performed by selecting from a set of symbols including one or more modifiable symbols, each modifiable symbol adapted to receive a modifier;

determining whether a corresponding modifier is available for each selected modifiable symbol;

modifying each selected modifiable symbol in respect of which a positive determination is made by adding the modifier to the modifiable symbol; and determining whether to make an award based on the plurality of symbols as modified.

In an embodiment, determining whether a modifier is available includes determining whether a corresponding modifier is displayed at a modifier display position associated with the display position of the modifiable symbol.

In an embodiment, determining whether a modifier is available includes determining whether the modifier matches the modifiable symbol.

In an embodiment, determining whether a modifier matches the modifiable symbol includes determining whether the shape of the modifier corresponds to the modifiable symbol.

In an embodiment, determining whether a modifier matches the modifiable symbol includes determining whether the modifier fits the modifiable symbol.

In an embodiment, at least one modifiable symbol is adapted to receive more than one modifier.

In an embodiment, at least one modifiable symbol is adapted to receive all modifiers.

In an embodiment, at least one modifier is adapted to modify more than one modifiable symbol.

In an embodiment, at least one modifier is adapted to modify all modifiable symbols.

In an embodiment, the method includes displaying a plurality of modifiers.

In an embodiment, at least one modifier is associated with each of a plurality of subsets of display positions.

In an embodiment, each subset of display positions corresponds to a reel of a spinning reel game.

In an embodiment, at least some symbols are not modifiable.

In an embodiment, the method includes selecting each modifier.

In an embodiment, the method includes performing the selection randomly.

In an embodiment, the determination of whether to make an award based on the plurality of symbols as modified is based solely on the modifier in respect of at least one symbol.

In a second aspect, the invention provides a game controller for a gaming system, the game controller arranged to:

select a plurality of symbols for display at a plurality of display positions by selecting from a set of symbols including one or more modifiable symbols, each modifiable symbol adapted to receive a modifier;

determine whether a corresponding modifier is available for each selected modifiable symbol;

modify each selected modifiable symbol in respect of which a positive determination is made by adding the modifier to the modifiable symbol; and determine whether to make an award based on the plurality of symbols as modified.

In an embodiment, the game controller includes a symbol selector arranged to select the plurality of symbols.

In an embodiment, the game controller includes a modifier controller arranged to determine whether a modifier is available and modify any modifiable symbol in respect of which a positive determination is made.

In an embodiment, the game controller includes an award evaluator arranged to determine whether to make an award based on the plurality of symbols as modified.

In an embodiment, the game controller is constituted by a processor arranged to execute program code stored in a memory.

In an embodiment, the memory stores the symbol set.

In an embodiment, the symbol set is constituted by a plurality of subsets corresponding to respective ones of a plurality of reels.

In an embodiment, the game controller is arranged to determine whether a modifier is available by determining whether a corresponding modifier is displayed at a modifier display position associated with the display position of the modifiable symbol.

In an embodiment, the game controller is arranged to determine whether a modifier is available by determining whether the modifier matches the modifiable symbol.

In an embodiment, the game controller is arranged to determine whether a modifier matches the modifiable symbol by determining whether the shape of the modifier corresponds to the modifiable symbol.

In an embodiment, the game controller is arranged to determine whether a modifier matches the modifiable symbol by determining whether the modifier fits the modifiable symbol.

In an embodiment, at least one modifiable symbol is adapted to receive more than one modifier.

In an embodiment, at least one modifiable symbol is adapted to receive all modifiers.

In an embodiment, at least one modifier is adapted to modify more than one modifiable symbol.

In an embodiment, at least one modifier is adapted to modify all modifiable symbols.

In an embodiment, the game controller is arranged to cause display of a plurality of modifiers.

In an embodiment, at least one modifier is associated with each of a plurality of subsets of display positions.

In an embodiment, each subset of display positions corresponds to a reel of a spinning reel game.

In an embodiment, at least some symbols are not modifiable.

In an embodiment, the game controller is arranged to select each modifier.

In an embodiment, the game controller is arranged to perform the selection randomly.

In an embodiment, the determination of whether to make an award based on the plurality of symbols as modified is based solely on the modifier in respect of at least one symbol.

In a third aspect, the invention provides a gaming system including:

a display; and a game controller arranged to:

select a plurality of symbols for display at a plurality of display positions on the display by selecting from a set of symbols including one or more modifiable symbols, each modifiable symbol adapted to receive a modifier;

determine whether a corresponding modifier is available for each selected modifiable symbol;

modify each selected modifiable symbol in respect of which a positive determination is made by adding the modifier to the modifiable symbol; and determine whether to make an award based on the plurality of symbols as modified.

In an embodiment, the display forms part of a player interface further including a game play mechanism operable by a player to input at least one game play instruction, and wherein the game controller is operative to select the symbols in response to the game play instructions.

In an embodiment, the gaming system includes a symbol selector arranged to select the plurality of symbols.

In an embodiment, the gaming system includes a modifier controller arranged to determine whether a modifier is available and modify any modifiable symbol in respect of which a positive determination is made.

In an embodiment, the gaming system includes an award evaluator arranged to determine whether to make an award based on the plurality of symbols as modified.

In an embodiment, the modifier controller is arranged to determine whether a modifier is available by determining whether a corresponding modifier is displayed at a modifier display position associated with the display position of the modifiable symbol.

In an embodiment, the modifier controller is arranged to determine whether a modifier is available by determining whether the modifier matches the modifiable symbol.

In an embodiment, the modifier controller is arranged to determine whether a modifier matches the modifiable symbol by determining whether the shape of the modifier corresponds to the modifiable symbol.

In an embodiment, the modifier controller is arranged to determine whether a modifier matches the modifiable symbol by determining whether the modifier fits the modifiable symbol.

In an embodiment, the game controller is arranged to cause display of a plurality of modifiers.

In an embodiment, at least one modifier is associated with each of a plurality of subsets of display positions.

In an embodiment, the gaming system includes a modifier selector arranged to select each modifier.

In an embodiment, the modifier selector is arranged to perform the selection randomly.

In an embodiment, the award evaluator is arranged to make the determination of whether to make an award based solely on the modifier in respect of at least one symbol.

In a fourth aspect, the invention provides a method of gaming including:

selecting a plurality of symbols for display at a plurality of display positions, the selecting being performed by selecting from a set of symbols including one or more modifiable symbols, each modifiable symbol adapted to receive a modifier;

selecting a modifier for each selected modifiable symbol;

modifying each selected modifiable symbol by adding the selected modifier to the modifiable symbol; and determining whether to make an award based on the plurality of symbols as modified.

In an embodiment, each subset of display positions corresponds to a reel of a spinning reel game.

In an embodiment, at least some symbols are not modifiable.

In an embodiment, the method includes performing the selection of the modifier randomly.

In a fifth aspect, the invention provides a game controller for a gaming system, the game controller arranged to:

select a plurality of symbols for display at a plurality of display positions, the selecting being performed by selecting from a set of symbols including one or more modifiable symbols, each modifiable symbol adapted to receive a modifier;

select a modifier for each selected modifiable symbol;

modify each selected modifiable symbol by adding the selected modifier to the modifiable symbol; and determine whether to make an award based on the plurality of symbols as modified.

In an embodiment, the game controller includes a symbol selector arranged to select the plurality of symbols.

In an embodiment, the game controller includes a modifier selector arranged to select the modifier.

In an embodiment, the game controller includes a modifier controller arranged to modify any modifiable symbol.

In an embodiment, the game controller includes an award evaluator arranged to determine whether to make an award based on the plurality of symbols as modified.

In an embodiment, the game controller is constituted by a processor arranged to execute program code stored in a memory.

In an embodiment, the memory stores the symbol set.

In an embodiment, each subset of display positions corresponds to a reel of a spinning reel game.

In an embodiment, at least some symbols are not modifiable.

In an embodiment, the game controller is arranged to perform the selection of the modifier randomly.

In a sixth aspect, the invention provides a gaming system including:

a display; and a game controller arranged to:

select a plurality of symbols for display at a plurality of display positions, the selecting being performed by selecting from a set of symbols including one or more modifiable symbols, each modifiable symbol adapted to receive a modifier;

select a modifier for each selected modifiable symbol;

modify each selected modifiable symbol by adding the selected modifier to the modifiable symbol; and determine whether to make an award based on the plurality of symbols as modified.

In an embodiment, the display forms part of a player interface further including a game play mechanism operable by a player to input at least one game play instruction, and wherein the game controller is operative to select the symbols in response to the game play instruction.

In an embodiment, the gaming system includes a symbol selector arranged to select the plurality of symbols.

In an embodiment, the gaming system includes a modifier selector arranged to select the modifier.

In an embodiment, the gaming system includes a modifier controller arranged to modify any modifiable symbol.

In an embodiment, the gaming system includes an award evaluator arranged to determine whether to make an award based on the plurality of symbols as modified.

In an embodiment, each subset of display positions corresponds to a reel of a spinning reel game.

In an embodiment, at least some symbols are not modifiable.

In an embodiment, the gaming system is arranged to perform the selection of the modifier randomly.

In a seventh aspect, the invention provides computer program code which when executed implements one or both of the above methods.

In an eighth aspect, the invention provides a computer readable medium including the above program code.

In a ninth aspect, the invention provides a data signal including the above program code.

In a tenth aspect, the invention extends to transmitting the above program code.

BRIEF DESCRIPTION OF DRAWINGS

Certain exemplary embodiments of the invention will now be described with reference to the accompanying drawings in which.

Figure 1:
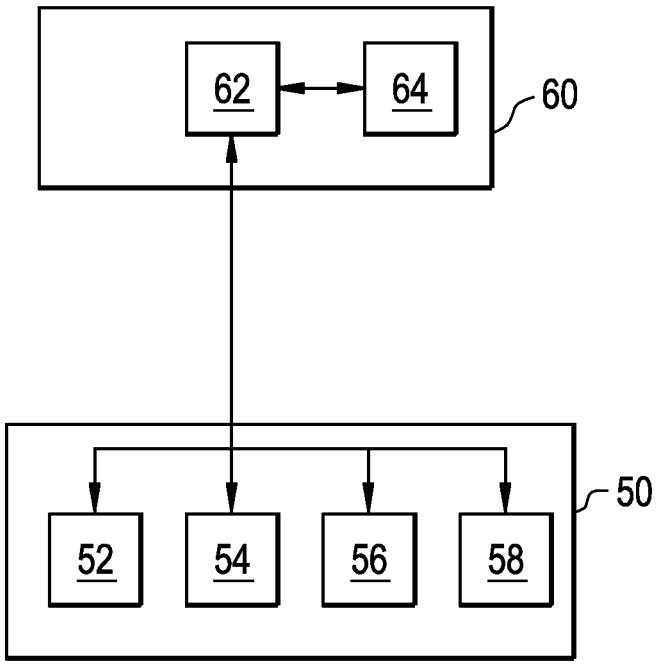
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Referring to the drawings, there is shown a gaming system having a game controller arranged to implement a game where selectable symbols include modifiable symbols adapted to receive a modifier. If a modifiable symbol is selected it may be modified by a corresponding modifier and awards evaluated based on the selected symbols as modified.

General Construction of Gaming System

The gaming system can take a number of different forms. In a first form, a stand alone gaming machine is provided wherein all or most components for implementing the game are present in a player operable gaming machine.

In a second form, a distributed architecture is provided wherein some of the components for implementing the game are present in a player operable gaming machine and some of the components for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system includes several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
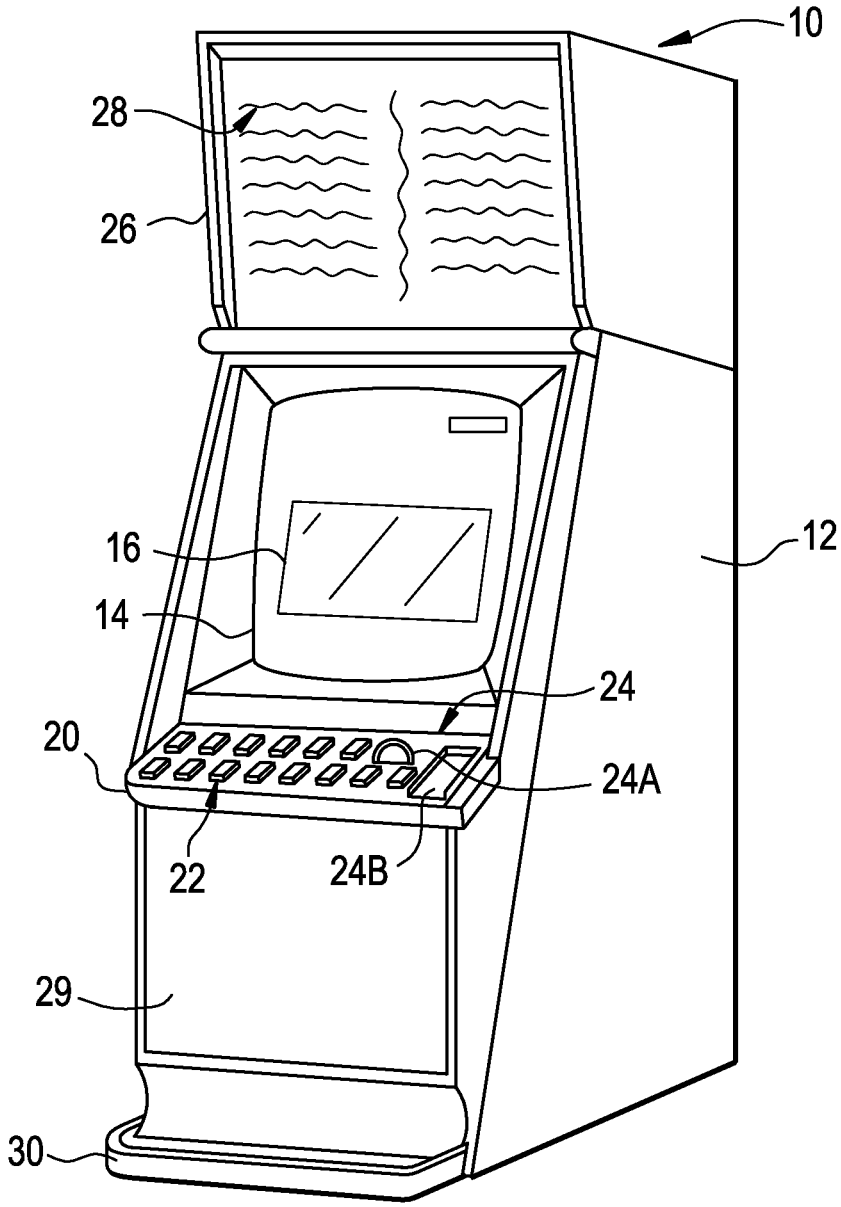
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
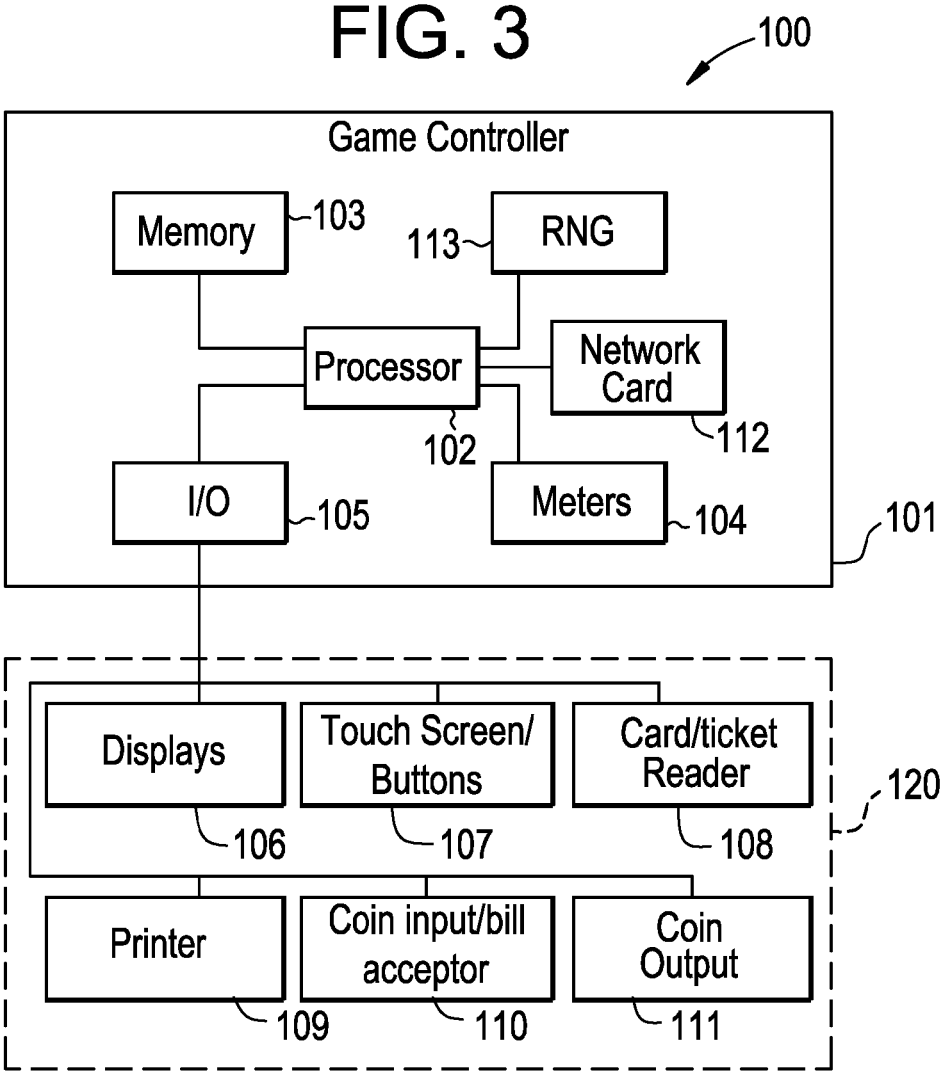
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101, including one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
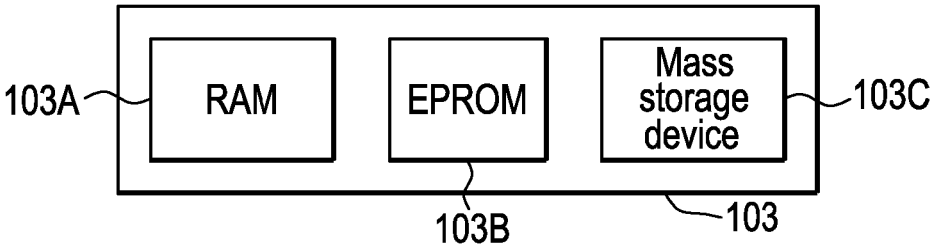
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
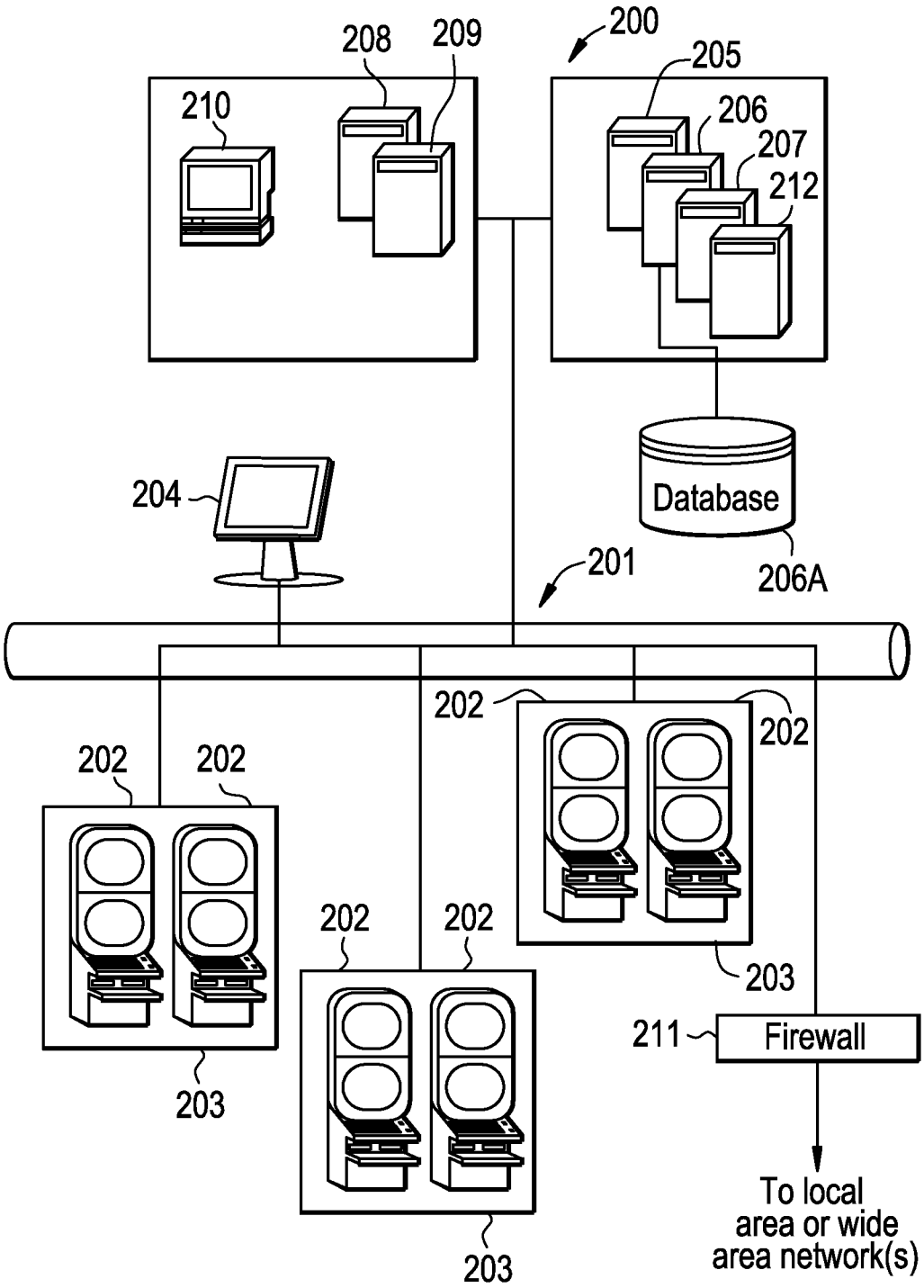
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games based on the terminals.

Further Detail of Gaming System

Figure 6:
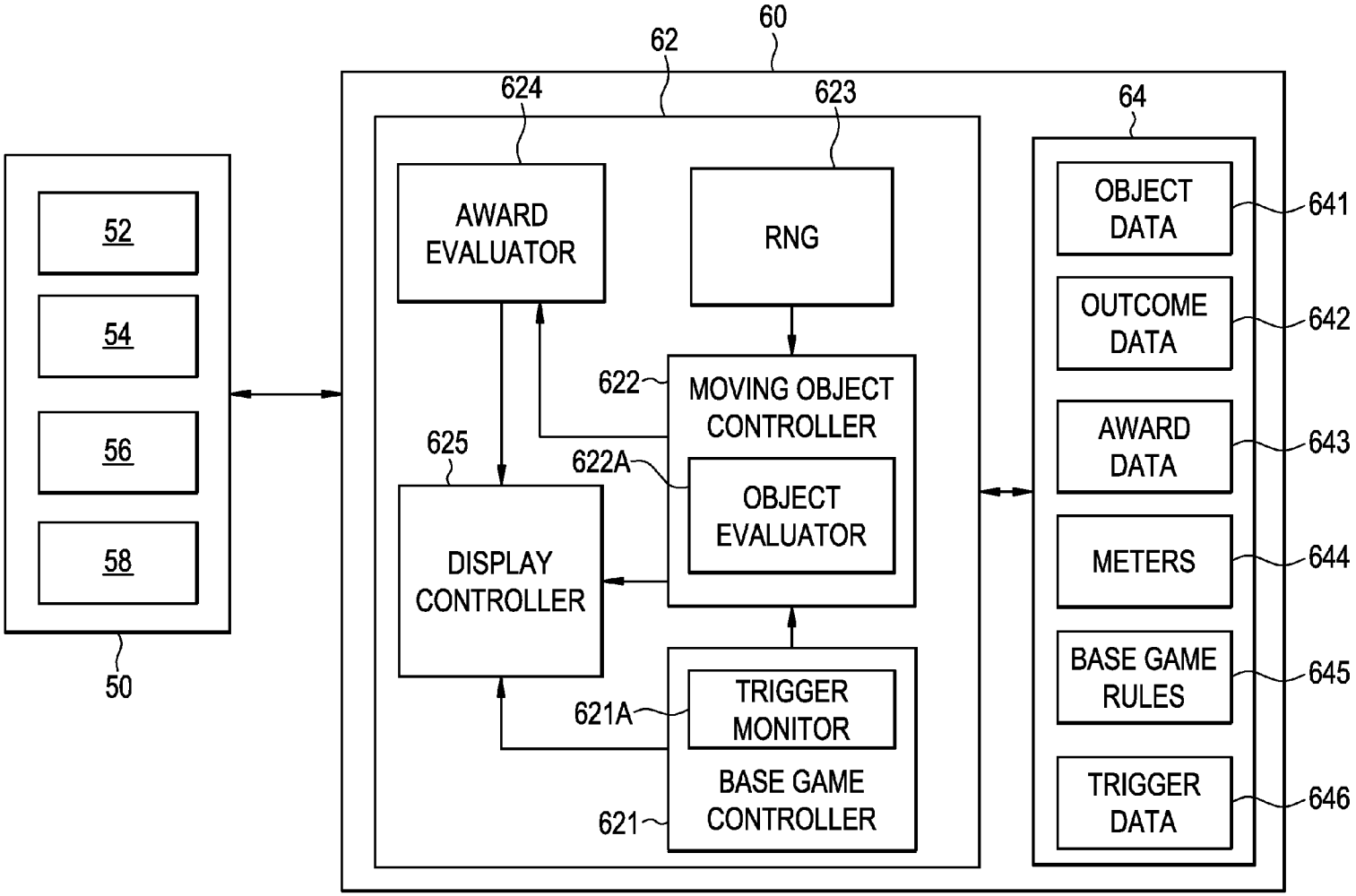
FIG. 6 is a further block diagram of a gaming system.

Referring to FIG. 6, it is illustrated that the game controller 60 is implemented by a processor 62 executing code stored in memory 64 to provide a plurality of modules 621-624. The outcome generator 622 operates in response to the player's operation of game play mechanism 56 to generate a game outcome which will then be evaluated by prize evaluator 623. The player's operation of the game play mechanism 56 will be to specify their win entitlement for the game. Typically by placing a bet.

Persons skilled in the art will appreciate that a player's win entitlement will vary from game to game and may or may not be dependent on player selections. In most spinning reel games, it is typical for the player's entitlement to be affected by the amount they wager and selections they make (i.e. the nature of the wager). For example, a player's win entitlement may be based on how many lines they will play in each game—i.e. a minimum of one line up to the maximum number of lines allowed by the game (noting that not all permutations of win lines may be available for selection. Such win lines are typically formed by a combination of displayed symbol positions, one from each reel, the symbol positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons, skilled in the art, will appreciate that in other embodiments, the player may obtain a win entitlement by selecting a number of reels to play. Such games are marketed under the trade name "Reel Power" by Aristocrat Leisure Industries Pty Ltd. The selection of the reel means that each displayed symbol of the reel can be substituted for a symbol at one or more designated display positions. In other words, all displayed symbol positions of a selected reel can be used to form symbol combinations with designated, displayed symbol positions of other reels.

In other embodiments a player win entitlement may be affected by purchasing access to particular pay tables—e.g. a first bet amount entitles the player to wins including cherries and a second amount entitles them to wins including plums. The win entitlement is not always purchased—e.g. a series of free games may be awarded.

Once, the player's win entitlement has been established, the first part of forming the game outcome is for a symbol selector 622A of outcome generator 622 to select symbols from a set of symbols specified by symbol data 641. The selected symbols are advised to the display controller 624 which causes them to be displayed on display 54 at a set of display positions. Accordingly, it will be appreciated that the display controller 624 may incorporate an appropriate graphics driver for the display.

One example of selecting symbols is for the symbol selector 622A to select symbols for display from a plurality of symbol sets corresponding to respective ones of a plurality of spinning reels. The symbol sets 641 can specify a sequence of symbols for each reel such that the symbol selector 622A can select a symbol by randomly selecting a stopping position in the sequence using random number generator 621. In one example, three symbols of each of five reels may be displayed such that symbols are displayed at fifteen display positions on display 54. In some embodiments, different weightings can be assigned to stop positions to control the odds of various outcomes.

In the embodiment, the selected symbols may include one or more modifiable symbols 641A. Each modifiable symbol has the characteristic that it can receive at least one modifier specified by modifier data 642 which is used in evaluating awards. Depending on the embodiment, some modifiable symbols may be adapted to receive more than one modifier or indeed be able to receive all modifiers. Similarly, some modifiers 642 may modify more than one modifiable symbol. Depending on the embodiment, the addition of a modifier to a modifiable symbol may result in an additional possible award evaluation in respect of the modifiable symbol, may be required for their to be any award evaluation in respect of the symbol, or may result in an alternative award evaluation. For example, a symbol portion of the modifiable symbol may indicate what evaluation is made in the absence of a modifier.

In the embodiment, the outcome generator 622 has a modifier selector 622B for selecting one or more modifiers 642 to be displayed on display 54 by display controller 624. The number of modifiers selected is determined by game rules 643. In one example, one modifier is selected for each reel specified by symbol data 641 and displayed in association with that reel while the reel spins. In this example, each modifier is only associated with one reel and hence is only available to modify symbols of that reel. In another example, one or more modifiers may be selected in advance and displayed separately from the reels on display 54 and may be available to modify any modifiable symbol irrespective of the reel. The modifiers may be selected randomly using random number generator 621, supplied in a designated order specified by modifier data 642 or in some other manner.

Modifier controller 622C then determines whether an available modifier matches a modifiable symbol based on match rules 643A. The match rules may specify, for example, that the modifiable symbol needs to be in a specific symbol position or that there needs to be a specific correspondence between the modifiable symbol and the modifier. In one example, a modifier needs to fit into a defined space in a modifiable symbol that is adapted to receive the modifier. In another, example certain modifiable symbols may be adapted to receive more than one modifier. In some embodiments, more than one modifier may be available to modify a symbol, whether because the modifiable symbol is adapted to receive more than one modifier or because two or more matching modifiers are available. Where more than one modifier can modify a modifiable symbol, match rules may specify how the modifiable symbol is selected, e.g. by the player or to provide the largest award. In another example, if more than one modifiable symbol is available to modify a modifiable symbol, each is evaluated in turn.

Once any symbols have been modified by modifier controller 622C, award evaluator 623, determines whether the symbols as modified correspond to any prizes specified by prize data 644, for example by looking up a table of all possible prize outcomes, and advises the player of any awards via display 54. In some embodiments, award evaluator 623 may also make awards prior to any modifications being made such that there is a first award without the modifier.

Persons skilled in the art will appreciate that the usual eligibility rules may apply, for example, modifiers may only be available in response to a trigger event, in a feature game sequence such as free games or re-spins, or for certain bets (e.g. an ante bet), or if the right to modify is purchased, for example after a modifiable symbol has been displayed.

Figure 7:
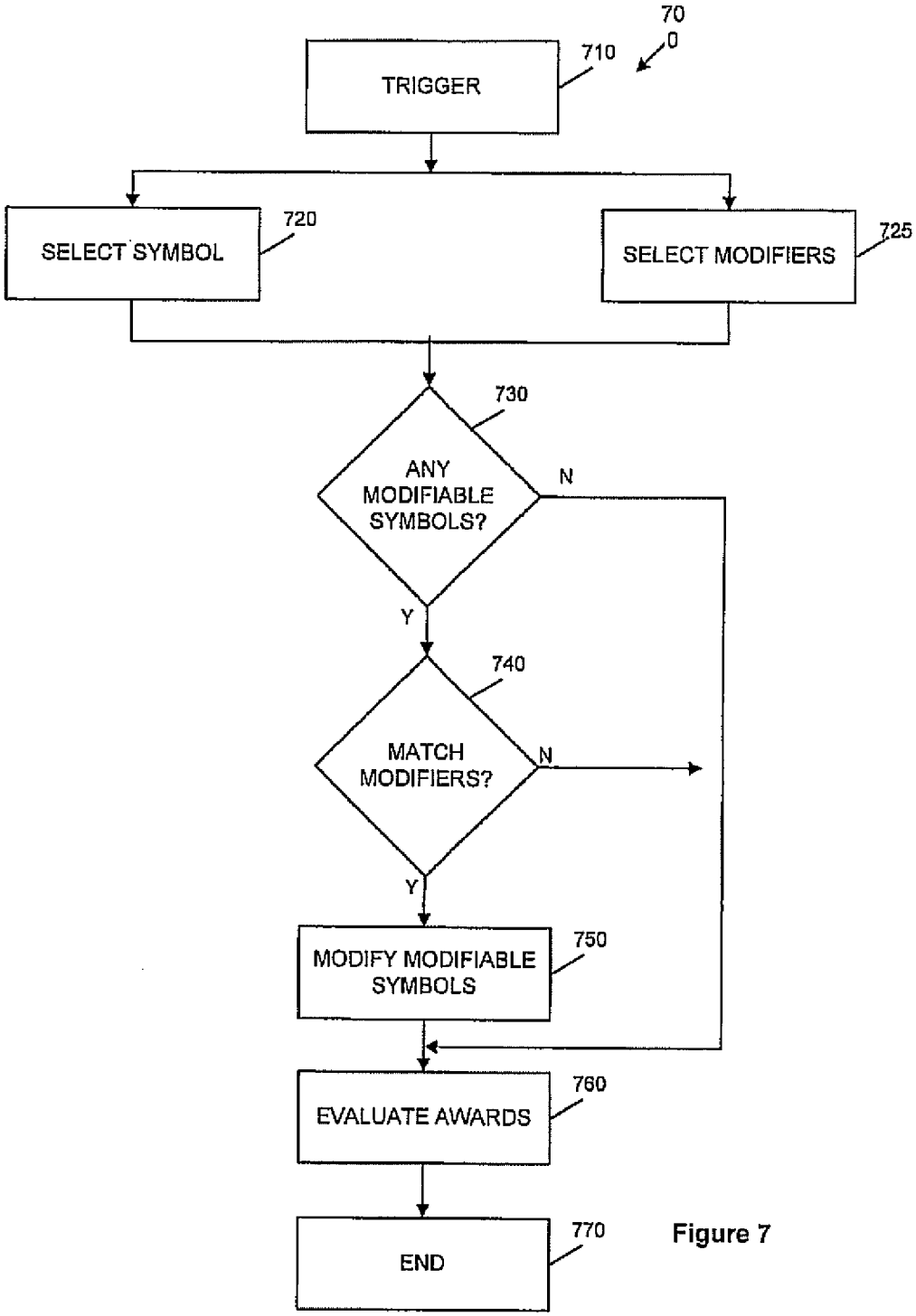
FIG. 7 is a flow chart of an embodiment.

The method 700 is summarised in FIG. 7 which shows that after the game starts 710, symbols are selected 720 independently of selection of modifiers 725. The method then involves determining 730 whether there are any modifiable symbols. If there are modifiable symbols, the method involves determining whether a modifier is available and matches 740. Matched modifiable symbols are then modified 750 and awards evaluated 760 before the game ends 770.

In an alternative embodiment, the modifier may be selected by modifier selector 622B using random number generator 621 after a modifiable symbol is selected and displayed. In one example of such an embodiment, whenever a modifiable symbol is selected, modifier controller 622C controls modifier selector 622B to selects a modifier randomly from modifier data, such that it is not necessary to determine whether the modifier matches the modifiable symbol. (The selection being restricted to those modifiers which will modify the modifiable symbol if this is necessary.)

Persons skilled in the art will also appreciate that the method of the embodiment could be embodied in program code. The program code could be supplied in a number of ways, for example on a computer readable medium, such as a disc or a memory (for example, that could replace part of memory 103) or as a data signal (for example, by downloading it from a server).

EXAMPLES

Example 1

Figure 8:
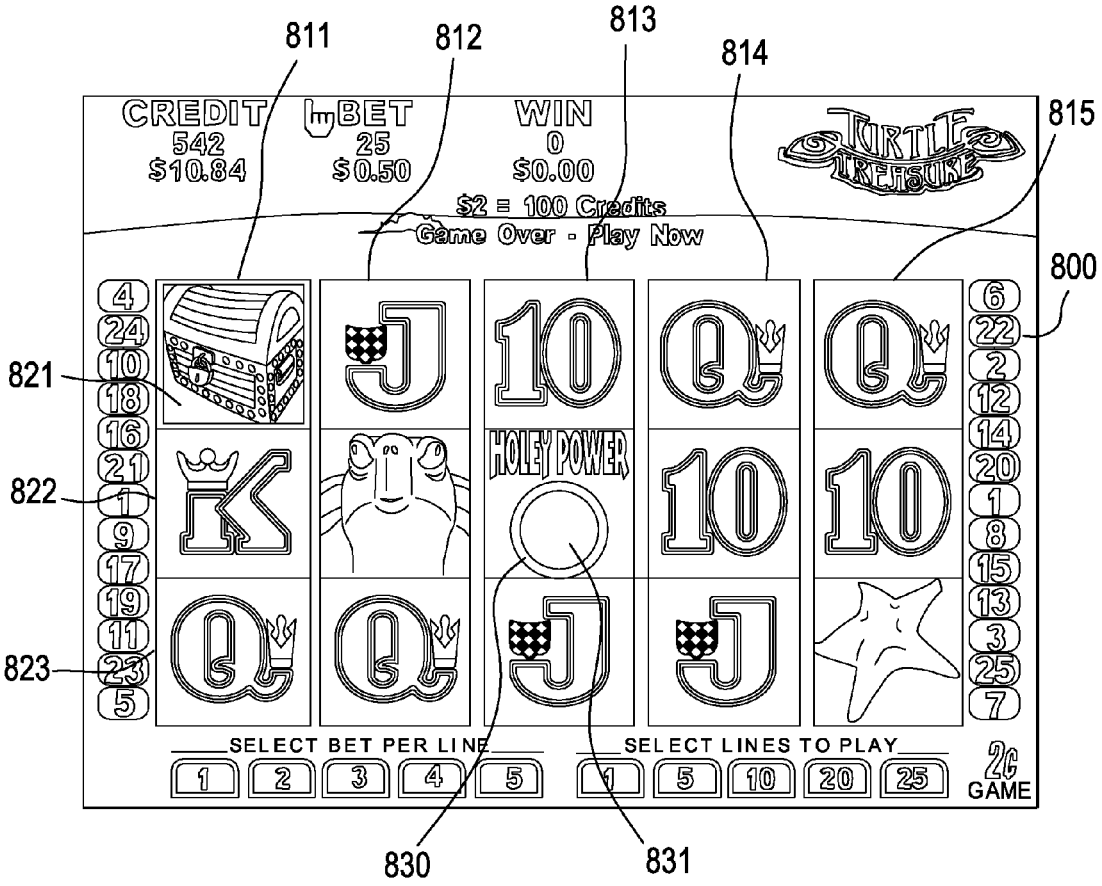
FIG. 8 is an exemplary display of a first example.
Figure 9:
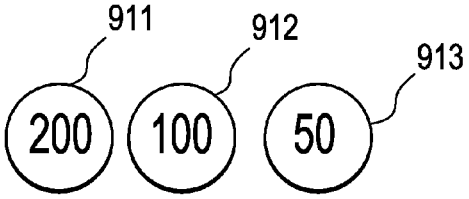
FIG. 9 shows exemplary modifiers of a first example.

Referring to FIG. 8 there is shown an exemplary display 800 of a first example where there are five reels 811 to 815 and three positions 821 to 823 are displayed of each reel such that 15 symbols are selected in total. The displayed symbols include a "holey power" symbol 830. The holey power symbol 830 is a modifiable symbol which has a hole 831 to indicate that it is modifiable. When the holey power symbol 830 appears, the game controller selects a modifier from the set of modifiers 911 to 913 as shown in FIG. 9 and places it in the holey power symbol. Game outcomes are evaluated based on that modified holey power symbol. In this example, the modified holey power symbol acts a wild symbol to substitute for all other symbols in combinations and also carries the additional prize of either 200 credits 911, 100 credits 912 or 50 credits 913 if it is involved in a winning combination. In this example, the modifiable symbol can receive any modifier.

Example 2

Figure 10:
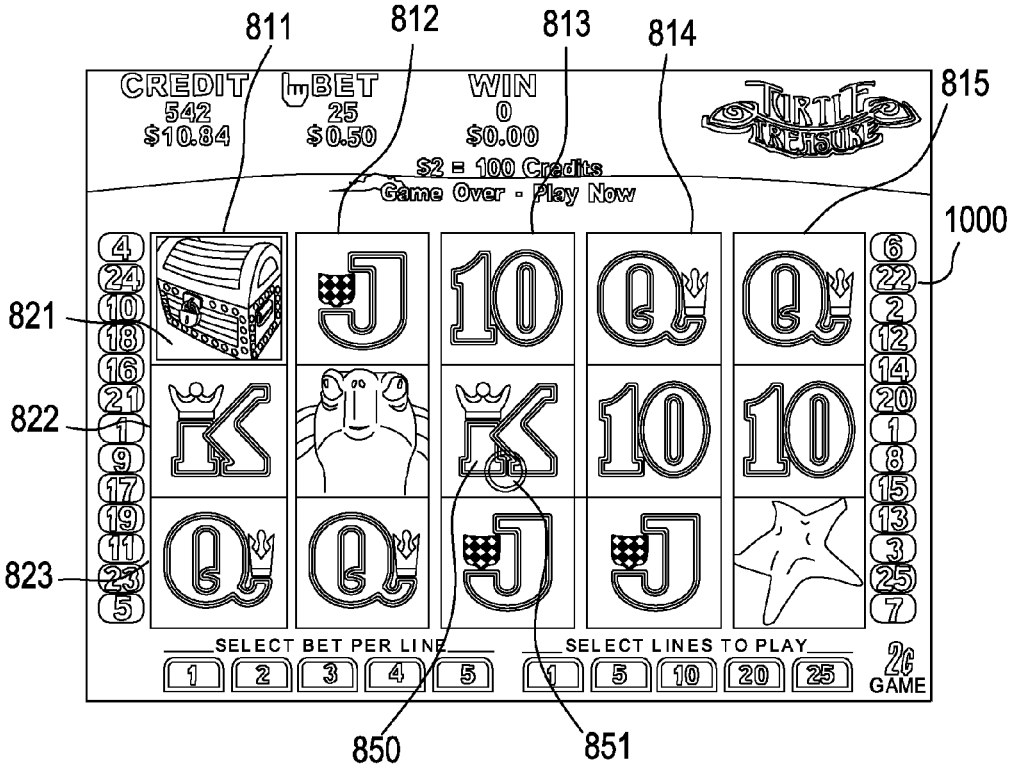
FIG. 10 is an exemplary display of a second example.

FIG. 10 shows an alternative display 1000 of a second example where the game is otherwise described in relation to FIG. 8 but the modifiable symbol 850 also includes a normal symbol portion, in this case a king symbol "K" which can form part of other win outcomes. In this case, the symbol prize is additional. Hole 851 indicates that the modifiable symbol is adapted to receive a modifier.

Example 3

Figure 11:
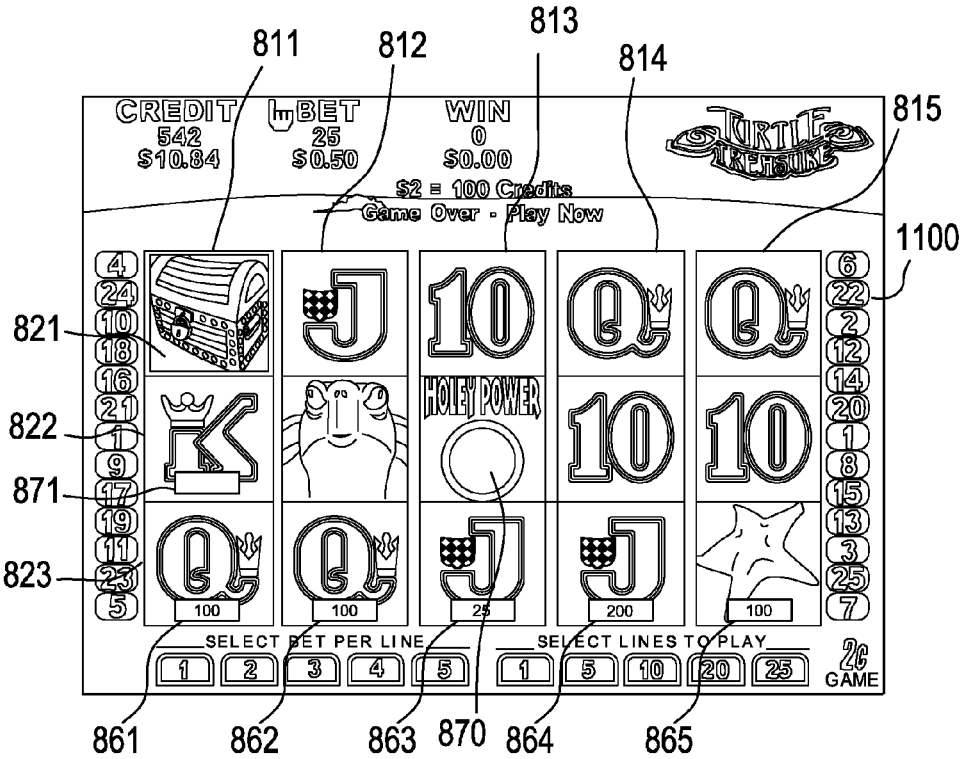
FIG. 11 is an exemplary display of a third example.

FIG. 11 shows an exemplary display 1100 having the same number of reels 811 to 815 with again three symbols being displayed on three rows 821 to 823 for each reel such that there are 15 display positions in total. In this example, a modifier is selected for each reel in the form of a block 861 to 865 which is displayed at the bottom of each reel 811 to 815 respectively. If a block will fit into the space of a modifiable symbol of the reel to which it belongs, that symbol will be modified by adding the modifier to the symbol and displaying the modifiable symbol as modified by the modifier. This can be implemented by match rules 643A including a look up table of modifiable symbols and the modifiers which fit each modifiable symbol.

In the example, none of the blocks fit specifically into the symbols of the reels with which they are associated. However, in this example, the holey power symbol 870 is able to receive any symbol irrespective of its shape and hence will receive block 863 of the third reel. In another embodiment, the holey power symbol 870 may only be able to receive round blocks. In one example, the blocks may only be allowed to modify modifiable symbols which stop in the bottom row 823 of the display positions. In other examples, the blocks may fit into any symbol on that reel. A person skilled in the art will appreciate, for example, that the block 862 will fit into hole 871 of the king symbol on the first reel 811. Block 863 would also fit into this spot. Depending on the specific match rules 643A, block 863 may be required to correspond exactly to the hole 871 or may be allowed to modify the modifiable symbol provided it fits into the hole 871 as would be the case with symbol 863.

Persons skilled in the art will appreciate that the shapes of the blocks including the protuberances on those blocks can be used to control the probability any modifiable symbol being modified. Persons skilled in the art will appreciate that in other examples each of the modifiers 861 to 865 maybe available for modification of a symbol on any reels. In such embodiments, rules may be defined which specify the order in which modifiable symbols are modified, for example, left to right across the reels 811 to 815 or by determining which modifications would result in the highest award to the player.

It will be understood to persons skilled in the art of the invention that many modifications may be made without departing from the spirit and scope of the invention. In particular, features of the above embodiments may be used to form other embodiments.

It is to be understood that, if any prior art publication is referred to herein, such reference does not constitute an admission that the publication forms a part of the common general knowledge in the art, in Australia or any other country.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The claims defining the invention are as follows:

1. A method of gaming comprising:

selecting a plurality of symbols for display at a plurality of display positions, the selecting being performed by selecting from a set of symbols that includes one or more unmodifiable symbols and one or more modifiable symbols, each modifiable symbol adapted to receive a modifier;

determining, using a processor, whether a corresponding modifier is available for each selected modifiable symbol;

modifying, using the processor, each selected modifiable symbol by adding the determined modifier to the modifiable symbol if a corresponding modifier is available, the one or more modifiable symbols each having a portion indicative of how the modifiable symbols are to be interpreted if a modifiable symbol is not available; and determining, using the processor, whether to make an award based on the plurality of symbols including any unmodifiable, modified and unmodified modifiable symbols.

2. A method as claimed in claim 1, wherein determining whether a modifier is available comprises determining whether a corresponding modifier is displayed at a modifier display position associated with the display position of the modifiable symbol.

3. A method as claimed in claim 1, wherein determining whether a modifier is available comprises determining whether the modifier matches the modifiable symbol.

4. A method as claimed in claim 3, wherein determining whether a modifier matches the modifiable symbol comprises determining whether the shape of the modifier corresponds to the modifiable symbol.

5. A method as claimed in claim 4, wherein determining whether a modifier matches the modifiable symbol includes determining whether the modifier fits the modifiable symbol.

6. A method as claimed in claim 1, wherein at least one modifiable symbol is adapted to receive more than one modifier.

7. A method as claimed in claim 6, wherein at least one modifiable symbol is adapted to receive all modifiers.

8. A method as claimed in claim 1, wherein at least one modifier is adapted to modify more than one modifiable symbol.

9. A method as claimed in claim 8, wherein at least one modifier is adapted to modify all modifiable symbols.

10. A method as claimed in claim 1, comprising displaying a plurality of modifiers.

11. A method as claimed in claim 10, wherein at least one modifier is associated with each of a plurality of subsets of display positions.

12. A method as claimed in claim 11, wherein each subset of display positions corresponds to a reel of a spinning reel game.

13. A method as claimed in claim 1, wherein at least some symbols are not modifiable.

14. A method as claimed in claim 1, comprising selecting each modifier.

15. A method as claimed in claim 14, comprising performing the selection randomly.

16. A method as claimed in claim 1, wherein the determination of whether to make an award based on the plurality of symbols as modified is based solely on the modifier in respect of at least one symbol.

17. A game controller for a gaming system, the game controller arranged to:

select a plurality of symbols for display at a plurality of display positions by selecting from a set of symbols that includes one or more unmodifiable symbols and one or more modifiable symbols, each modifiable symbol adapted to receive a modifier;

determine whether a corresponding modifier is available for each selected modifiable symbol;

modify each selected modifiable symbol by adding the determined modifier to the modifiable symbol if a corresponding modifier is available, the one or more modifiable symbols each having a portion indicative of how the modifiable symbols are to be interpreted if a modifiable symbol is not available; and determine whether to make an award based on the plurality of symbols including any unmodifiable, modified and unmodified modifiable symbols.

18. A game controller as claimed in claim 17, comprising a symbol selector arranged to select the plurality of symbols.

19. A game controller as claimed in claim 17, comprising a modifier controller arranged to determine whether a modifier is available and modify any modifiable symbol in respect of which a positive determination is made.

20. A game controller as claimed in claim 17, comprising an award evaluator arranged to determine whether to make an award based on the plurality of symbols as modified.

21. A game controller as claimed in claim 17 constituted by a processor arranged to execute program code stored in a memory.

22. A game controller as claimed in claim 21, wherein the memory stores the symbol set.

23. A game controller as claimed in claim 22, wherein the symbol set is constituted by a plurality of subsets corresponding to respective ones of a plurality of reels.

24. A game controller as claimed in claim 17, arranged to determine whether a modifier is available by determining whether a corresponding modifier is displayed at a modifier display position associated with the display position of the modifiable symbol.

25. A game controller as claimed in claim 17, arranged to determine whether a modifier is available by determining whether the modifier matches the modifiable symbol.

26. A game controller as claimed in claim 25, arranged to determine whether a modifier matches the modifiable symbol by determining whether the shape of the modifier corresponds to the modifiable symbol.

27. A game controller as claimed in claim 25, arranged to determine whether a modifier matches the modifiable symbol by determining whether the modifier fits the modifiable symbol.

28. A game controller as claimed in claim 17, wherein at least one modifiable symbol is adapted to receive more than one modifier.

29. A game controller as claimed in claim 28, wherein at least one modifiable symbol is adapted to receive all modifiers.

30. A game controller as claimed in claim 17, wherein at least one modifier is adapted to modify more than one modifiable symbol.

31. A game controller as claimed in claim 30, wherein at least one modifier is adapted to modify all modifiable symbols.

32. A game controller as claimed in claim 17, arranged to cause display of a plurality of modifiers.

33. A game controller as claimed in claim 32, wherein at least one modifier is associated with each of a plurality of subsets of display positions.

34. A game controller as claimed in claim 33, wherein each subset of display positions corresponds to a reel of a spinning reel game.

35. A game controller as claimed in claim 17, wherein at least some symbols are not modifiable.

36. A game controller as claimed in claim 17, arranged to select each modifier.

37. A game controller as claimed in claim 36, arranged to perform the selection randomly.

38. A game controller as claimed in claim 17, wherein the determination of whether to make an award based on the plurality of symbols as modified is based solely on the modifier in respect of at least one symbol.

39. A gaming system comprising:

a display; and a game controller arranged to:

select a plurality of symbols for display at a plurality of display positions on the display by selecting from a set of symbols that includes one or more unmodifiable symbols and one or more modifiable symbols, each modifiable symbol adapted to receive a modifier;

determine whether a corresponding modifier is available for each selected modifiable symbol;

modify each selected modifiable symbol by adding the determined modifier to the modifiable symbol if a corresponding modifier is available, the one or more modifiable symbols each having a portion indicative of how the modifiable symbols are to be interpreted if a modifiable symbol is not available; and determine whether to make an award based on the plurality of symbols including any unmodifiable, modified and unmodified modifiable symbols.

40. A gaming system as claimed in claim 39, wherein the display forms part of a player interface further comprising a game play mechanism operable by a player to input at least one game play instruction, and wherein the game controller is operative to select the symbols in response to the game play instruction.

41. A gaming system as claimed in claim 39, comprising a symbol selector arranged to select the plurality of symbols.

42. A gaming system as claimed in claim 39, comprising a modifier controller arranged to determine whether a modifier is available and modify any modifiable symbol in respect of which a positive determination is made.

43. A gaming system as claimed in claim 42, wherein the modifier controller is arranged to determine whether a modifier is available by determining whether a corresponding modifier is displayed at a modifier display position associated with the display position of the modifiable symbol.

44. A gaming system as claimed in claim 42, wherein the modifier controller is arranged to determine whether a modifier is available by determining whether the modifier matches the modifiable symbol.

45. A gaming system as claimed in claim 44, wherein the modifier controller is arranged to determine whether a modifier matches the modifiable symbol by determining whether the shape of the modifier corresponds to the modifiable symbol.

46. A gaming system as claimed in claim 44, wherein the modifier controller is arranged to determine whether a modifier matches the modifiable symbol by determining whether the modifier fits the modifiable symbol.

47. A gaming system as claimed in claim 39, comprising an award evaluator arranged to determine whether to make an award based on the plurality of symbols as modified.

48. A gaming system as claimed in claim 47, wherein the award evaluator is arranged to make the determination of whether to make an award based solely on the modifier in respect of at least one symbol.

49. A gaming system as claimed in claim 39, wherein the game controller is arranged to cause display of a plurality of modifiers.

50. A gaming system as claimed in claim 49, wherein at least one modifier is associated with each of a plurality of subsets of display positions.

51. A gaming system as claimed in claim 39, comprising a modifier selector arranged to select each modifier.

52. A gaming system as claimed in claim 51, wherein the modifier selector is arranged to perform the selection randomly.

53. A method of gaming comprising:

selecting a plurality of symbols for display at a plurality of display positions, the selecting being performed by selecting from a set of symbols that includes one or more unmodifiable symbols and one or more modifiable symbols, each modifiable symbol adapted to receive a modifier;

selecting a modifier for each selected modifiable symbol;

modifying, using a processor, each selected modifiable symbol by adding the selected modifier to the modifiable symbol if a corresponding modifier is available, the one or more modifiable symbols each having a portion indicative of how the modifiable symbols are to be interpreted if a modifiable symbol is not available; and determining, using a processor, whether to make an award based on the plurality of symbols including any unmodifiable, modified and unmodified modifiable symbols.

54. A method as claimed in claim 53, wherein each subset of display positions corresponds to a reel of a spinning reel game.

55. A method as claimed in claim 53, wherein at least some symbols are not modifiable.

56. A method as claimed in claim 53, comprising performing the selection of the modifier randomly.

57. A game controller for a gaming system, the game controller arranged to:

select a plurality of symbols for display at a plurality of display positions, the selecting being performed by selecting from a set of symbols that includes one or more unmodifiable symbols and one or more modifiable symbols, each modifiable symbol adapted to receive a modifier;

select a modifier for each selected modifiable symbol;

modify each selected modifiable symbol by adding the selected modifier to the modifiable symbol if a corresponding modifier is available, the one or more modifiable symbols each having a portion indicative of how the modifiable symbols are to be interpreted if a modifiable symbol is not available; and determine whether to make an award based on the plurality of symbols including any unmodifiable, modified and unmodified modifiable symbols.

58. A game controller as claimed in claim 57, comprising a symbol selector arranged to select the plurality of symbols.

59. A game controller as claimed in claim 57, comprising a modifier selector arranged to select the modifier.

60. A game controller as claimed in claim 57, comprising a modifier controller arranged to modify any modifiable symbol.

61. A game controller as claimed in claim 57, comprising an award evaluator arranged to determine whether to make an award based on the plurality of symbols as modified.

62. A game controller as claimed in claim 57, constituted by a processor arranged to execute program code stored in a memory.

63. A game controller as claimed in claim 62, wherein the memory stores the symbol set.

64. A game controller as claimed in claim 57, wherein each subset of display positions corresponds to a reel of a spinning reel game.

65. A game controller as claimed in claim 57, wherein at least some symbols are not modifiable.

66. A game controller as claimed in claim 57, arranged to perform the selection of the modifier randomly.

67. A gaming system comprising:

a display; and a game controller arranged to:

select a plurality of symbols for display at a plurality of display positions, the selecting being performed by selecting from a set of symbols that includes one or more unmodifiable symbols and one or more modifiable symbols, each modifiable symbol adapted to receive a modifier;

select a modifier for each selected modifiable symbol;

modify each selected modifiable symbol by adding the selected modifier to the modifiable symbol if a corresponding modifier is available, the one or more modifiable symbols each having a portion indicative of how the modifiable symbols are to be interpreted if a modifiable symbol is not available; and determine whether to make an award based on the plurality of symbols as modified including any unmodifiable, modified and unmodified modifiable symbols.

68. A gaming system as claimed in claim 67, wherein the display forms part of a player interface further comprising a game play mechanism operable by a player to input at least one game play instruction, and wherein the game controller is operative to select the symbols in response to the game play instruction.

69. A gaming system as claimed in claim 67, comprising a symbol selector arranged to select the plurality of symbols.

70. A gaming system as claimed in claim 67, comprising a modifier selector arranged to select the modifier.

71. A gaming system as claimed in claim 67, comprising a modifier controller arranged to modify any modifiable symbol.

72. A gaming system as claimed in claim 67, comprising an award evaluator arranged to determine whether to make an award based on the plurality of symbols as modified.

73. A gaming system as claimed in claim 67, wherein each subset of display positions corresponds to a reel of a spinning reel game.

74. A gaming system as claimed in claim 67, wherein at least some symbols are not modifiable.

75. A gaming system as claimed in claim 67, arranged to perform the selection of the modifier randomly.

76. A computer readable medium comprising computer program code which when executed causes a processor to implement a method of gaming, the method comprising:

selecting a plurality of symbols for display at a plurality of display positions, the selecting being performed by selecting from a set of symbols that includes one or more unmodifiable symbols and one or more modifiable symbols, each modifiable symbol adapted to receive a modifier;

determining whether a corresponding modifier is available for each selected modifiable symbol;

modifying each selected modifiable symbol in respect of which a positive determination is made by adding the determined modifier to the modifiable symbol if a corresponding modifier is available, the one or more modifiable symbols each having a portion indicative of how the modifiable symbols are to be interpreted if a modifiable symbol is not available; and determining whether to make an award based on the plurality of symbols including any unmodifiable, modified and unmodified modifiable symbols.

77. A computer readable medium comprising computer program code which when executed causes a processor to implement a method of gaming, the method comprising:

selecting a plurality of symbols for display at a plurality of display positions, the selecting being performed by selecting from a set of symbols that includes one or more unmodifiable symbols and one or more modifiable symbols, each modifiable symbol adapted to receive a modifier;

selecting a modifier for each selected modifiable symbol;

modifying each selected modifiable symbol by adding the selected modifier to the modifiable symbol if a corresponding modifier is available, the one or more modifiable symbols each having a portion indicative of how the modifiable symbols are to be interpreted if a modifiable symbol is not available; and determining whether to make an award based on the plurality of symbols including any unmodifiable, modified and unmodified modifiable symbols.

* * * * *